US011415029B1

(12) United States Patent
Dadam et al.

(10) Patent No.: US 11,415,029 B1
(45) Date of Patent: Aug. 16, 2022

(54) ENGINE OIL DILUTION CONTROL IN AUTOMOTIVE VEHICLES

(71) Applicant: Ford Global Technologies, LLC, Dearborn, MI (US)

(72) Inventors: Sumanth Dadam, New Hudson, MI (US); Vivek Kumar, Troy, MI (US); Douglas Martin, Canton, MI (US); Vinod Ravi, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 17/175,286

(22) Filed: Feb. 12, 2021

(51) Int. Cl.

| | |
|---|---|
| ***F02M 26/33*** | (2016.01) |
| ***F02M 26/04*** | (2016.01) |
| ***F02M 31/20*** | (2006.01) |
| ***F01P 3/18*** | (2006.01) |
| ***F01M 5/00*** | (2006.01) |
| ***F01M 5/02*** | (2006.01) |
| ***F01M 5/04*** | (2006.01) |

(52) U.S. Cl.
CPC ..... *F01M 5/007* (2013.01); *F01M 5/021* (2013.01); *F01M 5/04* (2013.01); *F01M 2250/60* (2013.01)

(58) Field of Classification Search
CPC ..... F02M 26/33; F02M 26/28; F02M 26/24; F02M 26/01; F02M 31/20; F02M 35/10222; F02M 31/08; F01P 3/18; F01P 7/165
See application file for complete search history.

(56) References Cited

U.S. PATENT DOCUMENTS

| | | | | |
|---|---|---|---|---|
| 8,091,359 | B2 * | 1/2012 | Ulrey | F02B 33/34 60/605.1 |
| 8,978,613 | B2 | 3/2015 | Will | |
| 9,470,173 | B2 | 10/2016 | Lehmen et al. | |
| 9,988,954 | B2 | 6/2018 | Macfarlane et al. | |
| 10,427,668 | B2 | 10/2019 | Martin et al. | |
| 10,662,852 | B2 | 5/2020 | Takemoto et al. | |
| 10,961,616 | B2 | 3/2021 | Lin et al. | |
| 2007/0089716 | A1 * | 4/2007 | Saele | F02M 26/32 60/320 |
| 2007/0089717 | A1 * | 4/2007 | Saele | F02M 26/15 60/320 |
| 2015/0047340 | A1 * | 2/2015 | Ulrey | F02D 41/068 60/273 |
| 2016/0222868 | A1 | 8/2016 | Alger, II et al. | |
| 2017/0022879 | A1 | 1/2017 | Gonze et al. | |
| 2017/0306806 | A1 * | 10/2017 | Kardos | F01K 25/08 |

(Continued)

*Primary Examiner* — Long T Tran
(74) *Attorney, Agent, or Firm* — Vincent Mastrogiacomo; McCoy Russell LLP

(57) ABSTRACT

Methods and systems are provided for controlling engine oil dilution in automotive vehicles. The method comprises heating coolant by operating an exhaust gas heat recovery device and circulating the heated coolant via a first coolant loop between the exhaust gas heat recovery device and a heat exchanger; and heating coolant by operating an exhaust gas recirculation cooler and circulating the heated coolant via a second coolant loop between the exhaust gas recirculation cooler and the heat exchanger, wherein the heated coolant from both the exhaust gas heat recovery device and the exhaust gas recirculation cooler mix at the heat exchanger and allows heating of an engine oil via the heat exchanger. In one example, the method prevents excessive accumulation of water and/or fuel in the engine oil.

19 Claims, 6 Drawing Sheets

(56) References Cited

U.S. PATENT DOCUMENTS

| | | | | |
|---|---|---|---|---|
| 2018/0094610 | A1* | 4/2018 | Quix | F02M 26/09 |
| 2018/0156146 | A1 | 6/2018 | Kim et al. | |
| 2019/0086166 | A1* | 3/2019 | Zhang | F28D 9/0093 |
| 2019/0153916 | A1* | 5/2019 | Kelly | F01M 1/18 |
| 2019/0249589 | A1* | 8/2019 | Ernst | F25B 27/02 |
| 2020/0191020 | A1* | 6/2020 | Delahanty | F01P 5/10 |

* cited by examiner

ENGINE OIL DILUTION CONTROL IN AUTOMOTIVE VEHICLES

FIELD

The present disclosure relates generally to methods and systems for controlling engine oil dilution in automotive vehicles.

BACKGROUND/SUMMARY

Engine oil may become diluted with water or fuel over time, which may reduce the capacity of the oil to lubricate the engine. Such conditions may be especially present in vehicles that have shorter drive cycle or cold engine operations, wherein the engine oil temperature may not reach a boiling point of fuel or water before the engine is stopped. Both gasoline vehicles as well as hybrid vehicles may be affected by this condition. However, it is more pre-dominant in hybrid electric vehicles (HEVs). HEVs include an internal combustion engine and a traction motor to provide power to propel the vehicle. Fuel and water may accumulate in the engine oil due to infrequent operation of the engine and/or the type of engine used in the vehicle.

One approach directed to removing fuel from engine oil is taught by Gonze et al. in U.S. Patent Application Publication No. 2017/0022879. Therein, a coolant control system comprising a fraction module and a coolant valve control module is described. The fraction module determines an oil fuel fraction and the coolant valve control module selectively actuates a coolant valve to enable coolant flow from an integrated exhaust manifold of an engine to an engine oil heat exchanger. Another system is shown by Kim et al. in U.S. Patent Application Publication No. 2018/0156146. Therein, a system of heat management for vehicles is described that includes a phase change material (PCM) to heat coolant via stored exhaust gas energy. A storage line is disposed between a PCM housing (storing the phase change material) and a coolant heat exchanger and an operation fluid is configured to flow therethrough.

However, the inventors herein have identified potential problems in the approaches such as those noted above. As one example, the coolant flow for heating engine oil described in Gonze is actuated only from the integrated exhaust manifold and thus, may not allow fast heating of engine oil. Moreover, the system heats the oil in response to an oil fuel fraction, which may not provide an accurate picture of the oil dilution level of an engine. Additionally, the system described in Kim uses PCM to heat coolant but the coolant is not directed to heating of engine oil and therefore, the system does not monitor oil temperature and/or oil dilution level.

The inventors herein have recognized the above issues, and others, and have developed a method that allows heating of engine oil via coolant, thereby preventing excessive accumulation of water/fuel in the engine oil. The method comprises heating coolant by operating an exhaust gas heat recovery device and circulating the heated coolant via a first coolant loop between the exhaust gas heat recovery device and a heat exchanger; and heating coolant by operating an exhaust gas recirculation cooler and circulating the heated coolant via a second coolant loop between the exhaust gas recirculation (EGR) cooler and the heat exchanger, wherein the heated coolant from both the exhaust gas heat recovery device and the exhaust gas recirculation cooler mix at the heat exchanger and allows heating of the engine oil via the heat exchanger.

The method, according to the present disclosure, uses coolant from an exhaust gas heat recovery (EGHR) device to heat oil through conduction via a heat exchanger. As one example, a controller, responsive to an estimated oil dilution level and/or engine oil temperature, operates an EGHR configured to heat coolant to increase a temperature of the coolant until the estimated oil dilution level falls below a first threshold or engine oil temperature exceeds a threshold limit. In addition, the method may also use coolant from an exhaust gas recirculation (EGR) cooler to heat oil through conduction via the heat exchanger. The EGR cooler may be operated by the controller, in response to the estimated oil dilution level and/or engine oil temperature, in order to heat coolant to increase a temperature of the coolant until the estimated oil dilution level falls below the first threshold or engine oil temperature exceeds the threshold limit. The heated coolant from the EGHR device and the EGR cooler may be recirculated via a first and second coolant loops, respectively, to the heat exchanger. The heated coolant from the first and second coolant loops may mix at the heat exchanger to allow heating of the engine oil via the heat exchanger.

In another example, the oil may be heated by heating coolant surrounding an exhaust component via a phase change material that is in thermal contact with the exhaust component and recirculating the heated coolant from the exhaust component to a heat exchanger. A controller, responsive to an estimated oil dilution level exceeding a first threshold, is programmed to operate valves to direct the heated coolant exiting the phase change material and recirculate the heated coolant through the heat exchanger. The heat exchanger uses the heated coolant to heat the oil flowing through the heat exchanger in order to increase temperature of the oil until the estimated oil dilution level falls below the first threshold.

The method, according to the present disclosure, provides several advantages. It greatly improves the ability to overcome water dilution of oil through an incremental response, especially in hybrid vehicles. As hybrid vehicles tend to have shorter drive cycles than conventional vehicles, frequent heating of engine oil above a temperature threshold to cause water or fuel to evaporate is difficult. The method, according to the present disclosure, quickly transfers waste heat from the exhaust gas to the oil via coolant circulation to increase oil temperature above the temperature threshold, thereby controlling oil dilution. This method of heating oil relies on both the EGHR device and the EGR cooler. The present invention may be applied to both full hybrid electric vehicles (FHEV) as well as plug-in hybrid electric vehicles (PHEV). Additionally, it includes navigation choice for autonomous and non-autonomous vehicles, and enhances driver notification to prevent customer dissatisfaction.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
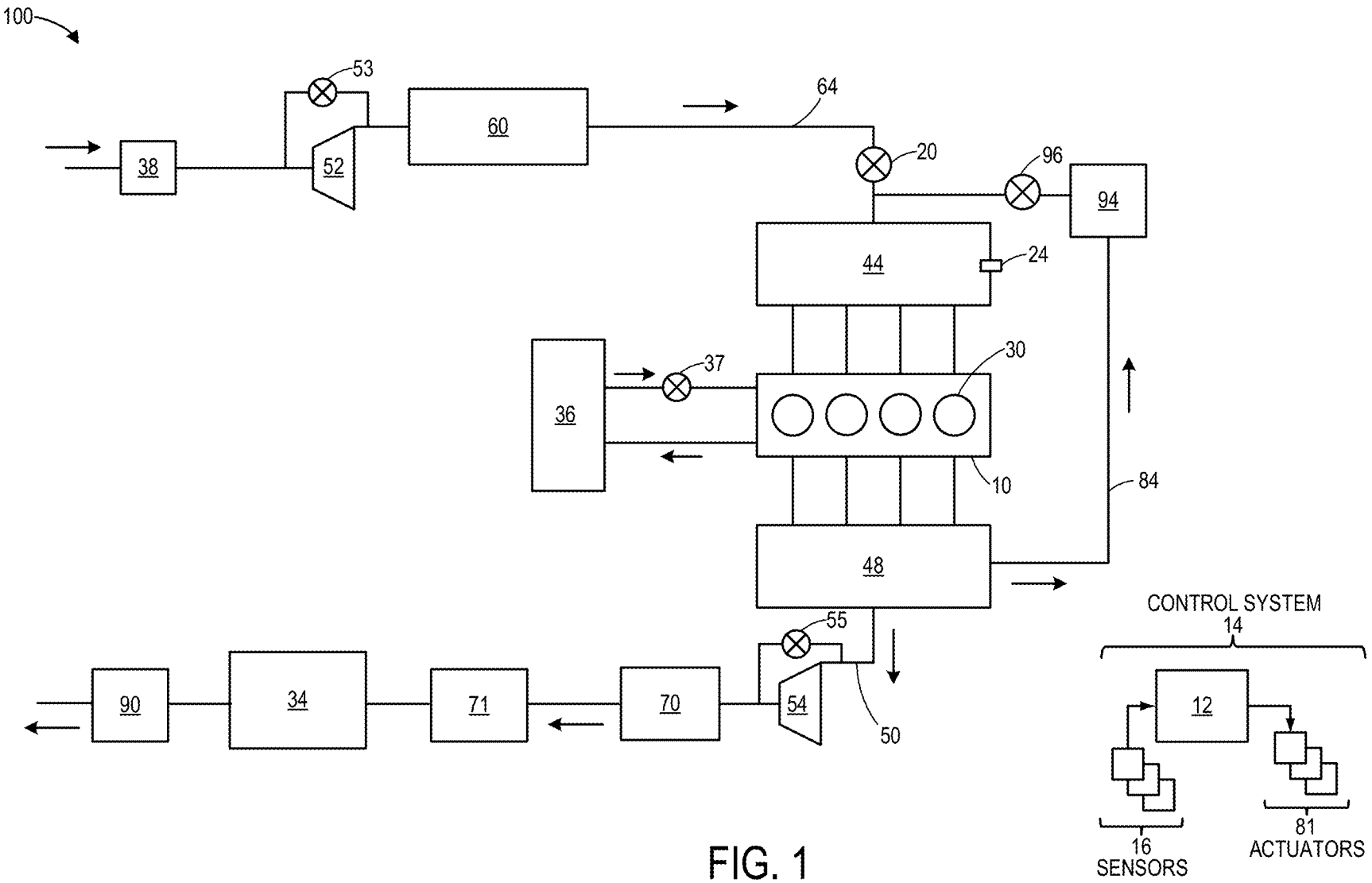
FIG. 1 shows a block diagram of a hybrid vehicle engine system including a heat exchanger.

The following description relates to methods and systems for controlling engine oil dilution in an automotive engine, such as the hybrid vehicle engine system of FIG. 1. The methods, according to the present disclosure, improve evaporation of fuel or water diluted in engine oil. A first example embodiment, comprising coolant loops and a heat exchanger, is provided in FIG. 2 for transferring heat from coolant to engine oil. The coolant loops include an exhaust gas heat recovery device and an exhaust gas recirculation cooler. A second example embodiment for transferring heat from coolant to engine oil via a phase change material is provided in FIG. 4. An engine controller may perform a control method, such as the example control methods of FIG. 3 and FIG. 5, to measure an engine oil dilution level and/or engine oil temperature and reroute coolant to heat engine oil, in response to an oil dilution level greater than a threshold or oil temperature less than a threshold limit. FIG. 6 shows an exemplary operation of engine oil heating to illustrate oil temperature, coolant flow, and valve adjustments in greater detail.

FIG. 1 shows a schematic diagram of a hybrid vehicle system 100. The hybrid vehicle system 100 includes an engine 10 and a motor (not shown) which may be included in a propulsion system of an automobile. Engine 10, having a plurality of cylinders 30, may be controlled at least partially by a control system 14 including controller 12 and by input from a vehicle operator via an input device (not shown in FIG. 1). The hybrid vehicle system 100 includes exhaust manifold 48 eventually leading to a tailpipe (not shown in FIG. 1) that eventually routes exhaust gas to the atmosphere.

The hybrid vehicle system 100 further includes control system 14. Control system 14 is shown receiving information from a plurality of sensors 16 and sending control signals to a plurality of actuators 81. As one example, sensors 16 may include manifold air pressure (MAP) sensor 24 located in intake manifold 44. Additionally, other sensors such as temperature, air-fuel ratio, and composition sensors may be coupled to various locations in vehicle system 100. As another example, the actuators may include actuators for fuel injectors (not shown), throttle 20, and other control valves that are not shown in FIG. 1. As shown in FIG. 1, throttle 20 provides a source of cool air to engine 10 which may be diluted with an exhaust gas recirculation (EGR), for example.

An exhaust gas recirculation (EGR) system may route a desired portion of exhaust gas from exhaust manifold 48 to intake passage 64 via EGR passage 84. The amount of EGR provided to intake passage 64 may be varied by controller 12 via EGR valve 96. Further, the EGR system may include an EGR cooler 94 to transfer heat from the exhaust gases to coolant, for example.

The hybrid vehicle system 100 further includes charge air cooler (CAC) 60. CAC 60 is arranged along the intake passage 64 upstream of throttle 20 for cooling the engine intake air after it has passed through a turbocharger and/or if it is diluted with EGR, for example. Further, air filter 38 is shown arranged along the intake passage 64 upstream of CAC 60. For example, air filter 38 may remove particulates from the intake air.

Control system 14 includes controller 12. Controller 12 may be a microcomputer including the following, although not shown in FIG. 1: a microprocessor unit, input/output ports, an electronic storage medium for executable programs and calibration values (e.g., a read only memory chip), random access memory, keep alive memory, and a data bus. Storage medium read-only memory may be programmed with computer readable data representing instructions executable by the microprocessor for performing the methods described below as well as other variants that are anticipated but not specifically listed. For example, the controller may receive communication (e.g., input data) from the various sensors, process the input data, and trigger the actuators in response to the processed input data based on instruction or code programmed therein corresponding to one or more routines.

Engine 10 may further include a compression device such as a turbocharger or supercharger including at least a compressor 52 arranged along the intake passage 64. For a turbocharger, compressor 52 may be at least partially driven by turbine 54 via a shaft (not shown) arranged along the exhaust passage. For a supercharger, compressor 52 may be at least partially driven by the engine and/or an electric machine, and may not include a turbine. Further, vehicle system 100 includes compressor bypass valve (CBV) 53 to release pressure in the intake system when the engine is boosted. Wastegate 55 is provided to divert exhaust gases to regulate the speed of turbine 54.

Engine 10 is shown coupled to exhaust passage 50 upstream of emission control devices 70, 71 and 90 in FIG. 1. As an example, emission control devices 70, 71 and 90 may be a three-way catalyst (TWC), NOx trap, particulate filter, selective catalyst reduction (SCR) system, various other emission control devices, or combinations thereof. In the illustrated example, a front catalyst 70 and a rear catalyst 71 are positioned upstream of a gasoline particulate filter (GPF) 90. The front catalyst 70 and the rear catalyst 71 are configured to oxidize and/or reduce various exhaust emissions, such as unburnt hydrocarbons and carbon monoxide. The GPF 90 is configured to trap particulates in the exhaust stream and burn the particulates off at a later time. In some embodiments, during operation of engine 10, emission control devices 70, 71 and/or 90 may be periodically reset by operating at least one cylinder of the engine within a particular air/fuel ratio.

Further, as shown in the example embodiment of FIG. 1, the hybrid vehicle system 100 includes a heat exchanger 36. Heat exchanger 36 may be a liquid-to-liquid heat exchanger for exchanging heat between engine oil and a fluid circulating through the powertrain such as coolant. The flow of oil through the heat exchanger 36 may optionally be shut off via valve 37. Furthermore, the heat exchanger 36 may be a split heat exchanger with two or more sections. A first section of the heat exchanger and a second section of the heat exchanger may be symmetrically sized. In an alternate embodiment, the heat exchanger may be asymmetrically sized wherein the first section of the heat exchanger is larger than the second section of the heat exchanger. Alternatively, the second section of the heat exchanger may be larger than the first section of the heat exchanger.

Additionally, in the illustrated example, an exhaust gas heat recovery (EGHR) device 34 is positioned along the exhaust passage 50 downstream of emission control devices 70 and 71 and upstream of emission control device 90. The EGHR device 34 may comprise a gas flow conduit and a gas-to-liquid heat exchanger. The gas-to-liquid heat exchanger of the EGHR device 34 is configured to extract heat from exhaust gas moving through the gas flow conduit of the EGHR device 34 and transfer the heat to the coolant. The coolant may be a water/glycol coolant. More details about coolant loops will be presented in FIGS. 2 and 4.

Figure 2:
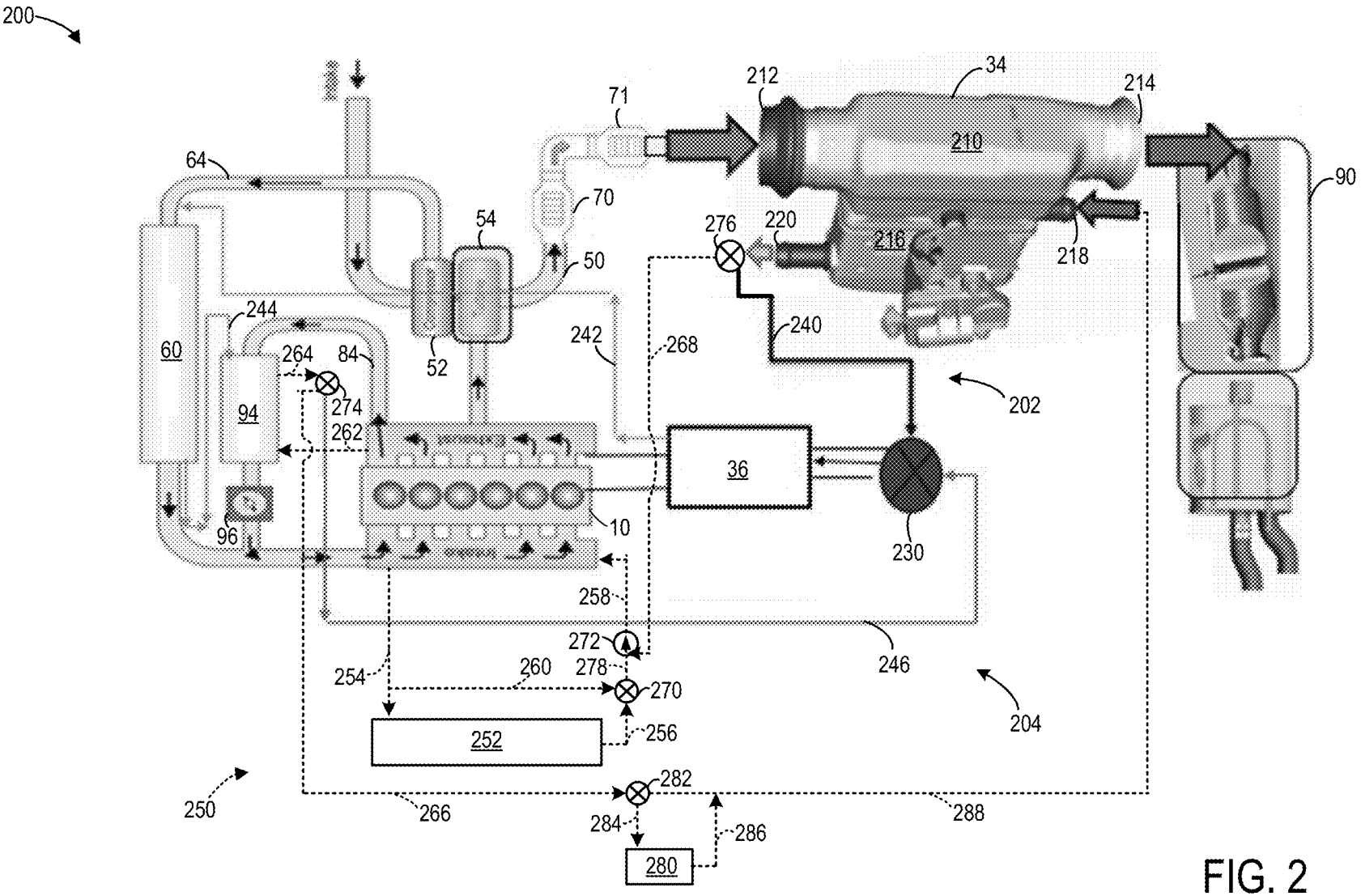
FIG. 2 shows a first example embodiment for heat transfer from coolant to engine oil via coolant loops, according to the present disclosure.

Turning to FIG. 2, FIG. 2 shows a schematic diagram of a first vehicle system 200 depicting coolant loops. The first vehicle system 200 of FIG. 2 is a non-limiting example of the hybrid vehicle system 100 of FIG. 1. As such, components previously introduced in FIG. 1 are numbered similarly in FIG. 2 and not reintroduced for brevity. FIG. 2 specifically provides a first example embodiment for heat transfer from coolant to engine oil via a first and second coolant loops including EGR cooler, EGHR device and heat exchanger, according to the present disclosure. Additionally, how the first and second coolant loops interact with main engine coolant loop is also presented in FIG. 2.

A schematic of a main engine coolant loop 250 is shown. The main engine coolant loop 250 may selectively cool or heat engine 10. Dotted line segments shown between devices represent conduits or passages (e.g., 266) for coolant. Direction of flow through the conduits or passages is indicated by the direction of the arrow heads.

The main engine coolant loop 250 includes a coolant pump 272 that may be driven via engine 10 or via an electric motor (not shown). The coolant pump 272 supplies coolant to engine 10 via a passage 258. The coolant may warm or cool the engine 10. The coolant may flow from the engine 10 via a passage 254 to a radiator 252. Alternatively, or in addition, the coolant may flow from engine 10 via a passage 262 to exhaust gas recirculation (EGR) cooler 94. The coolant may flow from the EGR cooler 94 to a second bypass valve 274 via a passage 264. The coolant may flow from the second bypass valve 274 to a heater core bypass valve 282 via a passage 266 when the second bypass valve 274 is in a first position. The coolant, in turn, may flow from the heater core bypass valve 282 to a heater core 280 via a passage 284.

The heater core 280 may selectively heat air in at least a portion of a passenger cabin (not shown). The heater core bypass valve 282 may allow coolant to bypass (e.g., not flow through) the heater core 280 via a bypass passage 288 when the heater core bypass valve 282 is in a first position. The heater core bypass valve 282 may allow coolant to flow through the heater core 280 via the passage 284 when the heater core bypass valve 282 is in a second position. The coolant flowing through the heater core 280 may join the bypass passage 288 via a passage 286. The coolant may flow from the heater core bypass valve 282 to EGHR device 34 via the bypass passage 288.

The coolant may flow into the EGHR device 34 via an inlet 218. The coolant may flow out of the EGHR device 34 via an outlet 220. The coolant may flow from the EGHR device 34 to a first bypass valve 276 via the outlet 220. The coolant may flow from the first bypass valve 276 back to the coolant pump 272 via a passage 268 when the first bypass valve 276 is in a first position. The coolant may flow from the radiator 252 to a valve 270 via a passage 256, from where the coolant may, in turn, flow to the coolant pump 272 via a passage 278. In one example, the valve 270 may be an electrically controlled thermostat having a position that is adjusted via controller 12 in response to a temperature of the engine 10. The coolant may also flow from the engine 10 to the valve 270 via a passage 260, from where the coolant may, in turn, flow to the coolant pump 272 via the passage 278.

Engine cooling: As the engine reaches a predetermined operating temperature (e.g., >85° C.), valve 270 may begin to open so that coolant may flow from the radiator 252 to the engine 10 to cool the engine 10. The radiator 252 may cool the coolant when air passes through the radiator 252. Warm coolant may flow to the heater core 280 when cabin heating is requested via vehicle occupants.

Engine heating: At lower engine temperatures, valve 270 may be closed so that coolant does not flow from the radiator 252 to the engine 10. However, the coolant may flow from the EGHR device 34 to the coolant pump 272 and engine 10 to heat engine 10. In particular, heat from exhaust gases may warm the coolant via EGHR device 34 and the heat contained in the coolant may then be transferred to the engine 10 to reduce engine warm-up time and engine emissions.

In the example embodiment of FIG. 2, apart from the main engine coolant loop 250, two additional coolant loops are shown: a first coolant loop 202 and a second coolant loop 204. Both the first coolant loop 202 and the second coolant loop 204 are indicated in solid line segments to differentiate them from the main engine coolant loop 250. The first coolant loop 202 and the second coolant loop 204 may be activated when engine oil heating is needed for controlling oil dilution.

As depicted in FIG. 2, the first coolant loop 202 includes the exhaust gas heat recovery (EGHR) device 34 and a heat exchanger 36. The coolant may flow through the first coolant loop 202 circulating between the EGHR device 34 and the heat exchanger 36, when the first bypass valve 276 is in a second position. Additionally, a regulatory valve 230 regulates the flow of coolant from the EGHR device 34 to the heat exchanger 36.

The second coolant loop 204, as shown in FIG. 2, includes an exhaust gas recirculation (EGR) cooler 94 and the heat exchanger 36. The coolant may flow through the second coolant loop 204 circulating between the EGR cooler 94 and the heat exchanger 36, when the second bypass valve 274 is in a second position. The regulatory valve 230 regulates the flow of coolant from the EGR cooler 94 to the heat exchanger 36.

In the illustrated example, the heat exchanger 36 is a coolant to oil heat exchanger, wherein engine oil circulating in the heat exchanger is heated by flowing coolant into the heat exchanger. The transfer of heat from coolant to engine oil takes place via conduction. More details about the method of heating engine oil via coolant to oil heat exchanger is presented below.

The method, according to the first example embodiment of the present disclosure, uses coolant from the EGHR device 34 as well as from the EGR cooler 94 to heat the engine oil through conduction. For example, during a cold engine start condition, a controller responsive to an estimated oil dilution level above a first threshold and/or engine oil temperature below a threshold limit, operates the EGHR device 34 and activates the first coolant loop 202. In some embodiments, the controller may be same as the controller 12 of the control system 14 of FIG. 1. The EGHR device 34, operated by the controller, is configured to heat coolant to increase a temperature of the coolant. In some embodiments, temperature sensors may be included in coolant line and engine oil for sensing the temperatures of the coolant and the engine oil. In some examples, the temperature sensors may be electronically coupled to the controller, and may be configured to send a signal indicating the temperatures of the coolant and the engine oil thereto.

As depicted in FIG. 2, upon operation of the EGHR device 34, the coolant present inside a gas-to-liquid heat exchanger 216 of the EGHR device 34 gets heated by exhaust gases traveling through a gas flow conduit 210 of the EGHR device 34. Exhaust gases traveling through the exhaust passage 50 enters the gas flow conduit 210 of the EGHR device 34 via a first inlet 212. The exhaust gases exit the gas flow conduit 210 of the EGHR device 34 via a first outlet 214. The direction of coolant circulating around the EGHR device 34 is configured to be opposite to the direction of travel of exhaust gases. The coolant enters the gas-to-liquid heat exchanger 216 of the EGHR device 34 via the inlet 218. The coolant exits the gas-to-liquid heat exchanger 216 of the EGHR device 34 via the outlet 220. The gas-to-liquid heat exchanger 216 of the EGHR device 34 extracts heat from exhaust gases moving through the gas flow conduit 210 of the EGHR device 34 and transfers the heat to the coolant flowing through the gas-to-liquid heat exchanger 216. The coolant exiting the EGHR device 34 via the outlet 220 travels to the first bypass valve 276. The first bypass valve 276, being in a second position, allows coolant from the EGHR device 34 to flow through the first coolant loop 202. The coolant may flow via a passage 240 of the first coolant loop 202 to reach the heat exchanger 36. An opening of the regulatory valve 230 regulates the flow of coolant into the heat exchanger 36. This operation of the EGHR device 34, heating of coolant, and routing of coolant from the EGHR device 34 to the heat exchanger 36 via the first coolant loop 202 continues until the estimated oil dilution level falls below the first threshold or until the engine oil temperature exceeds the threshold limit. While the first coolant loop 202 is active, the coolant from the EGHR device 34 is not sent to the coolant pump 272 of the main engine coolant loop 250.

Additionally, the second coolant loop 204 may also be activated in response to an estimated oil dilution level being above the first threshold and/or engine oil temperature being below the threshold limit, during a cold engine start condition, for example. As depicted in FIG. 2, coolant exiting the EGR cooler 94 via the passage 264 travels to the second bypass valve 274. The second bypass valve 274, being in a second position, allows routing of the coolant from the EGR cooler 94 to the second coolant loop 204. The coolant may flow via a passage 246 of the second coolant loop 204 to reach the heat exchanger 36. The opening of the regulatory valve 230 regulates the flow of coolant into the heat exchanger 36. This adds additional coolant to the heat exchanger 36 for heating engine oil to control oil dilution. This operation of the second coolant loop 204, and routing of coolant from the EGR cooler 94 to the heat exchanger 36 continues until the estimated oil dilution level falls below the first threshold or until the engine oil temperature exceeds the threshold limit. While the second coolant loop 204 is active, the coolant from the EGR cooler 94 is not sent to the heater core bypass valve 282 of the main engine coolant loop 250.

The coolant flowing through the heat exchanger 36 transfers the heat to the heat exchanger 36, wherefrom the heat is transferred to the engine oil circulating in the heat exchanger 36. This transfer of heat from the coolant to the engine oil takes place via conduction. As such, the engine oil circulating in the heat exchanger 36 is heated, while the coolant flowing through the heat exchanger 36 is cooled. This method of heating engine oil using coolant at the heat exchanger 36 may continue until the estimated engine oil dilution level falls below the first threshold and/or until the engine oil temperature exceeds the threshold limit. The increase in temperature of the engine oil beyond the threshold limit assists in evaporating fuel or water from engine oil, thereby improving lubrication capacity of the engine oil. After the completion of the transfer of heat, the cooled coolant is diverted from the heat exchanger 36 via a passage 242 to the CAC 60, wherefrom the coolant is routed back to the EGR cooler 94 via a passage 244. Thus, the second coolant loop 204 includes the CAC 60, the EGR cooler 94, and the heat exchanger 36, where coolant flows from the CAC 60 to the EGR cooler 94, from the EGR cooler 94 to the heat exchanger 36, and from the heat exchanger 36 back to the CAC 60. The coolant flowing from the heat exchanger 36 to the CAC 60 (e.g., via passage 242) may be relatively cool, having transferred heat in the coolant to the engine oil. The coolant may be heated at the CAC 60 and also at the EGR cooler 94, such that the coolant in passage 244 is warmer than the coolant in passage 242. Coolant in passage 246 may be relatively warm, due to absorbing heat from the exhaust gas via the EGR cooler 94, and thus may be warmer than coolant in passage 244, at least in some examples.

The regulatory valve 230 controls a rate of flow of the coolant from both the EGHR device and the EGR cooler. The regulatory valve 230 is also configured to be a blending valve that allows mixing or blending of coolant from the first and second coolant loops at the heat exchanger 36.

Additionally, in some examples, depending on the temperature needs of the engine oil for dilution control, coolant circulated through the heat exchanger 36 may come from only one of the sources, either EGHR device 34 or EGR cooler 94. In those examples, either the first coolant loop or the second coolant loop may be operated by the controller. For example, the engine oil may be heated by operating the EGHR device 34 configured to heat coolant for an engine to increase a temperature of the coolant, and responsive to an estimated oil dilution level of the engine exceeding a first threshold and engine oil temperature below a temperature threshold, routing the heated coolant from the EGHR device 34 to the heat exchanger 36 to increase a temperature of the engine oil. The simultaneous operation of the second coolant loop connected to the EGR cooler 94 may not be necessary. However, in examples where faster heating of the coolant and engine oil is requested, both the EGHR device 34 and the EGR cooler 94 (and the respective first and second coolant loops) may be operated at the same time to heat the coolant and recirculate the heated coolant through the heat exchanger 36 for heating engine oil above the temperature threshold. As such, in those examples, coolant circulated through the heat exchanger 36 comes from both the sources, the EGHR device 34 as well as the EGR cooler 94.

As the oil dilution level falls below the first threshold and/or the engine oil temperature exceeds the threshold limit, oil heating may no longer be needed. As such, the first and second coolant loops may be inactivated when oil heating is not indicated. Both the first bypass valve 276 and the second bypass valve 274 may allow coolant to bypass (e.g., not flow through) the heat exchanger 36. When oil heating is not indicated, the first bypass valve 276 is in the first position, thereby allowing flow of coolant from the EGHR device 34 to the coolant pump 272 via the passage 268. From the coolant pump 272, the coolant may be directed back to the main engine coolant loop as described previously. When oil heating is not indicated, the second bypass valve 274 is in the first position, thereby allowing flow of coolant from the EGR cooler 94 to the heater core bypass valve 282 via the passage 266. Thus, no coolant flows through the first coolant loop 202 or the second coolant loop 204 when oil heating is not indicated. Additionally, the regulatory valve 230 also gets closed when oil heating is not needed, thereby stopping the flow of coolant into the heat exchanger 36.

Figure 3:
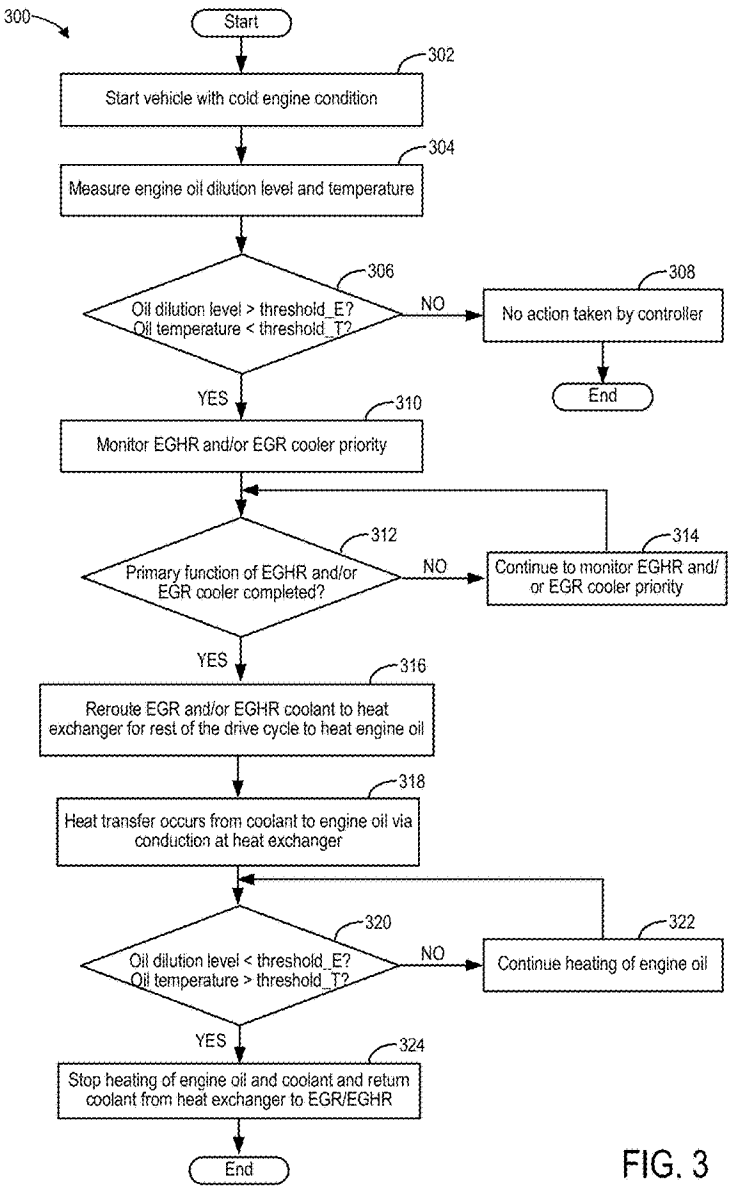
FIG. 3 shows a high-level flow chart of the controls for method of heating oil, in accordance with the first example embodiment of FIG. 2.

Turning now to FIG. 3, an example method 300 for engine oil heating is shown, in accordance with the first example embodiment of FIG. 2. Instructions for carrying out method 300 may be executed by a controller based on instructions stored in a memory of the controller and in conjunction with signals received from sensors of the vehicle system, such as the sensors and controller described above with reference to FIGS. 1-2.

At 302, the method includes starting or operating a vehicle. In one example, the vehicle may be operated under cold engine conditions. At 304, the method includes estimating and/or measuring engine oil dilution level. The engine oil dilution level may be estimated and/or measured by the controller from one or more of an output of an intake oxygen sensor, commanded fuel injection quantities, and/or measurement of oil viscosity, for example. Additionally, method 300 may also include estimating and/or measuring engine oil temperature at 304.

At 306, the method further includes determining if the engine oil dilution level is greater than a first threshold (e.g., threshold_E). At 306, the method may also include determining whether the engine oil temperature is lower than a temperature threshold (e.g., threshold_T). If it is determined that the engine oil dilution level is below the threshold_E (or the first threshold) or if it is determined that engine oil temperature is greater than the threshold_T (or the temperature threshold), method 300 continues to 308, where no action is taken by the controller and first/second coolant loops are not activated (only the main engine coolant loop remains active) and then ends. On the other hand, if it is established that engine oil dilution level is greater than threshold_E or engine oil temperature is lower than threshold_T, method 300 proceeds to 310.

At 310, the priority and coolant needs of the EGHR device and the EGR cooler of the vehicle system may be monitored. For example, it may be monitored whether the EGHR device and the EGR cooler need coolant for their own primary functions. As one example, EGR cooler may need coolant to lower the temperature of exhaust gases that are recirculated back into the engine by the EGR system. Therefore, depending on the coolant needs of the EGHR device and the EGR cooler, rerouting of the coolant from the EGHR device and the EGR cooler may be controlled.

At 312, the method determines whether the primary functions of the EGHR device and EGR cooler are completed. If it is determined at 312 that the primary functions of the EGHR device and EGR cooler are not completed, method 300 continues to 314, where monitoring of the coolant needs of the EGHR device and EGR cooler is continued. On the other hand, if it is established that the primary functions of the EGHR device and EGR cooler are completed, and the coolant is no longer needed by the EGHR device and EGR cooler for the rest of the drive cycle, method 300 progresses to 316.

At 316, the EGHR device and the EGR cooler are operated to heat the coolant and the heated coolant is rerouted from the EGHR device and the EGR cooler to a heat exchanger for rest of the drive cycle, in order to increase the temperature of the engine oil. The operation of the EGHR device and the EGR cooler and routing of heated coolant to the heat exchanger from the EGHR device and the EGR cooler may occur via the activation of the first and second coolant loops, in the same way as described previously with reference to FIG. 2.

At 318, the method further includes allowing heat transfer from coolant to engine oil at the heat exchanger. The transfer of heat occurs via conduction, as described previously in FIG. 2. This leads to an increase in the temperature of the engine oil circulating in the heat exchanger and a decrease in the temperature of the coolant flowing through the heat exchanger.

At 320, the method includes determining if the engine oil dilution level has fallen below threshold_E (or the first threshold) or if the engine oil temperature has exceeded threshold_T (or the temperature threshold). If it is determined at 320 that engine oil dilution level is greater than threshold_E or if it is determined that engine oil temperature is lower than threshold_T, method 300 continues to 322, where heating of engine oil and operation of first and second coolant loops continue. On the other hand, if it is established that engine oil dilution level is below threshold_E or engine oil temperature is greater than threshold_T, method 300 proceeds to 324.

At 324, routing of coolant to heat exchanger from EGHR device and EGR cooler is stopped. The heating of engine oil is also terminated. The coolant from heat exchanger is returned to the main engine coolant loop via CAC, as described previously with reference to FIG. 2.

Figure 4:
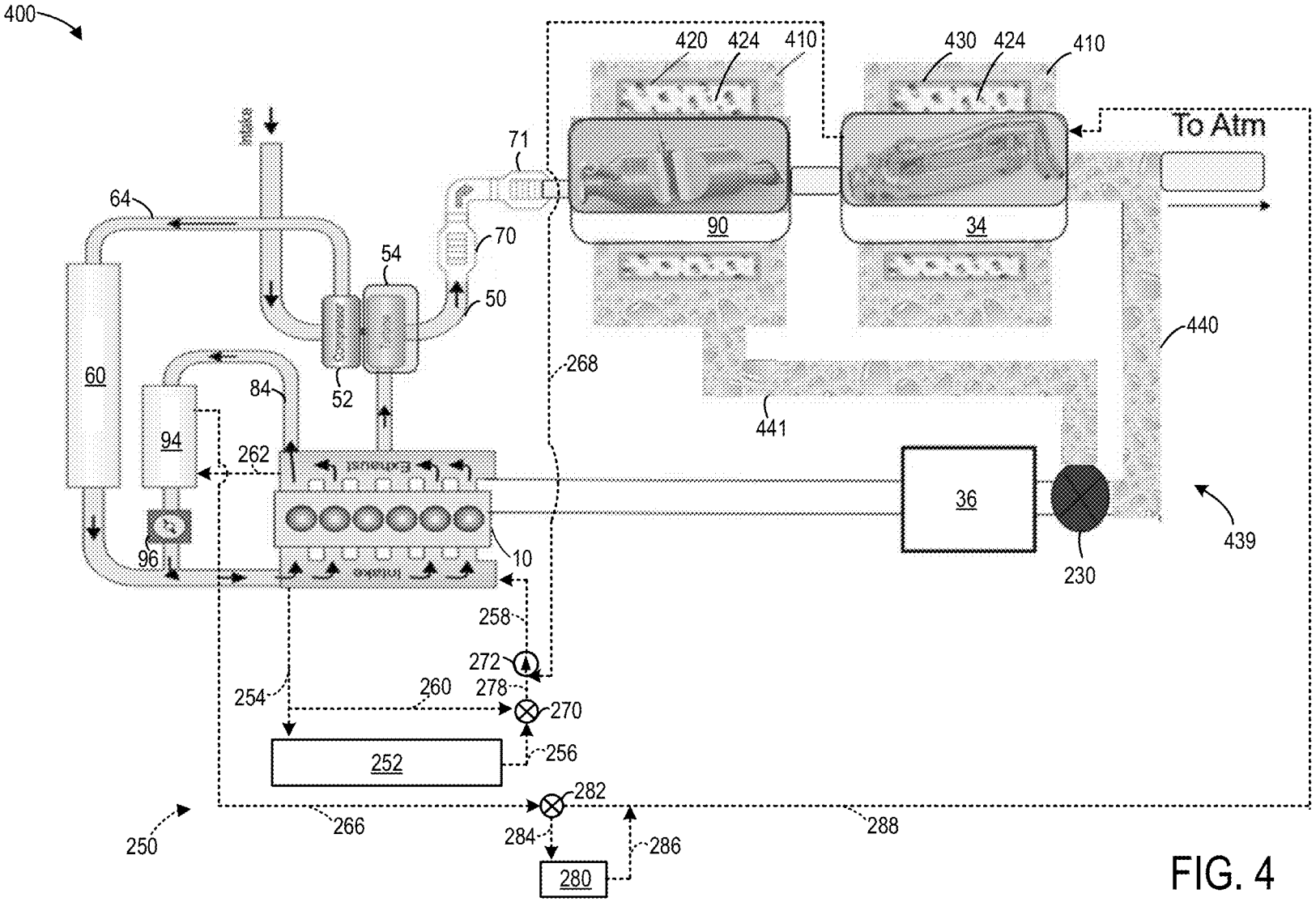
FIG. 4 shows a second example embodiment for heat transfer from coolant to engine oil via a phase change material, according to the present disclosure.

Referring to FIG. 4, FIG. 4 shows a schematic diagram of a second vehicle system 400 depicting a main engine coolant loop 250, a coolant circuit 439 and a phase change material 424. The second vehicle system 400 of FIG. 4 is a non-limiting example of the hybrid vehicle system 100 of FIG. 1. The main engine coolant loop 250 shown here in the second vehicle system 400 of FIG. 4 is similar to the main engine coolant loop of FIG. 2. As such, components previously introduced in FIGS. 1 and 2 are numbered similarly in FIG. 4 and not reintroduced for brevity. FIG. 4 specifically provides a second example embodiment for heat transfer from coolant to engine oil via a phase change material, according to the present disclosure.

In the example embodiment of FIG. 4, GPF 90 and EGHR device 34 installed in the exhaust passage 50 of the second vehicle system 400, may be sheathed by a first thermal jacket 420 and a second thermal jacket 430, respectively. Each of the first thermal jacket 420 and the second thermal jacket 430, may comprise a phase change material (PCM) 424. The PCM may be in thermal contact with the exhaust components (GPF 90 and EGHR device 34). A phase change material may be defined as a chemical formulation that undergoes a phase transition from a first phase to a second phase at a phase transition temperature (PTT) inherent to the material. Typically, this phase transition is between a solid phase and a liquid phase. The PCM absorbs a quantity of heat (known as a fusion energy) while in the first phase. By placing the PCM in a heat transfer relationship with an object, the PCM may absorb heat as the object increases in temperature, thus maintaining the temperature of the object.

The chemical composition of the PCM, which may include paraffin, polyethylene glycols, lithium nitrate trihydrate, and/or various organic and inorganic compounds, determines the PTT and fusion energy of the PCM. As such, an appropriate PCM may be chosen to fill the first thermal jacket 420 and the second thermal jacket 430 based on the size of the exhaust device and the composition of the exhaust gases, etc. In other words, the composition and quantity of PCM 424 within the first thermal jacket 420 and the second thermal jacket 430 may be selected to match the expected amount of heat generated by the GPF 90 and EGHR device 34, respectively. PCM 424 may be stored in bulk within the first thermal jacket 420 and the second thermal jacket 430, or may be embedded in granules. The PCM may be distributed evenly throughout the first thermal jacket 420 and the second thermal jacket 430, or may be distributed based on the profile and configuration of the GPF 90 and EGHR device 34. Thus, as the temperature of the GPF and the EGHR device increases due to the flowing hot exhaust gases, the heat may be transferred to the PCM, thereby mitigating the temperature increase of the GPF and the EGHR device.

As depicted in FIG. 4, a coolant circuit 439 is coupled to the GPF 90 and the EGHR device 34. The coolant circuit 439 surrounds the PCM 424 on an outer wall of each of the first thermal jacket 420 and the second thermal jacket 430. A coolant 410 circulates through the coolant circuit 439 around the GPF 90 and the EGHR device 34. The PCM 424 is configured to remain physically separate from the coolant 410 flowing through the coolant circuit 439, without mixing. The coolant circuit 439 further connects coolant lines of the GPF 90 and the EGHR device 34 with heat exchanger 36 via a coolant passage 441 and a coolant passage 440, respectively. A regulatory valve 230 regulates the flow of coolant 410 from the EGHR device 34 and the GPF 90 to the heat exchanger 36.

In the illustrated example, the entire exhaust component (e.g., EGHR device or GPF) is shown to be coated in PCM and enveloped in the coolant line. In other examples, however, a portion of a housing of the exhaust component (e.g., EGHR device or GPF) may be coated in PCM that may have coolant flowing over it. In yet other examples, a portion of an exhaust pipe at an inlet or an outlet of the exhaust component (e.g., EGHR device or GPF) may be coated with PCM which, in turn, may be surrounded by coolant.

The coolant circuit 439 shown in the illustrated example, constitutes a separate circuit, e.g., separate from the main engine coolant loop 250. In some examples, however, the coolant circuit 439 may be coupled to the main engine coolant loop 250. The regulatory valve 230 controls a rate of flow of the coolant 410 from both the EGHR device 34 and the GPF 90. The regulatory valve 230 is also configured to be a blending valve that allows mixing or blending of coolant from the EGHR device 34 and the GPF 90 at the heat exchanger 36.

In the illustrated example, the heat exchanger 36 is a coolant to oil heat exchanger, wherein engine oil circulating in the heat exchanger is heated by flowing coolant into the heat exchanger. The transfer of heat from coolant to engine oil takes place via conduction. More details about the method of heating engine oil via coolant to oil heat exchanger is presented below.

The method, according to the second example embodiment of the present disclosure, uses coolant 410 from the coolant circuit 439 surrounding the EGHR device 34 and the GPF 90 to heat the engine oil via PCM. For example, during a cold engine start condition, a controller responsive to an estimated oil dilution level exceeding a first threshold and/or engine oil temperature less than a threshold limit, is programmed to operate valve of the coolant circuit 439. In some embodiments, the controller may be same as the controller 12 of the control system 14 of FIG. 1 and the valve of the coolant circuit 439 may be the regulatory valve 230. The operation of the coolant circuit 439 allows heating of the coolant 410 via PCM 424, directs the heated coolant 410 exiting phase change material 424 towards the coolant passages 440 and 441, and recirculates the coolant through the heat exchanger 36 to increase temperature of the engine oil. This operation of the coolant circuit 439, the regulatory valve 230, and routing of coolant from the EGHR device 34 and the GPF 90 to the heat exchanger 36 continues until the estimated oil dilution level falls below the first threshold or until the engine oil temperature exceeds the threshold limit.

In some embodiments, temperature sensors may be included in coolant line and engine oil for sensing the temperatures of the coolant and the engine oil. In some examples, temperature sensors may be electronically coupled to the controller, and may be configured to send a signal indicating the temperatures of the coolant and the engine oil thereto.

As depicted in FIG. 4, exhaust gases coming out of the engine 10 flow through the exhaust passage 50 of the second vehicle system 400. As hot exhaust gases move through the GPF 90 and the EGHR device 34 along the exhaust passage 50, the heat or the thermal energy gets absorbed by the PCM 424 surrounding the GPF 90 and the EGHR device 34. The PCM 424, then stores the heat and is capable of transferring the heat to the coolant 410 surrounding the PCM 424 via conduction. The stored heat or thermal energy, provided not being utilized by the exhaust components (GPF 90 and EGHR device 34) for their own operation, is then used to heat the coolant 410 of the coolant circuit 439 surrounding the exhaust components. The heated coolant 410 is then directed to the heat exchanger 36 via the coolant passages 440 and 441 to heat the engine oil. An opening of the regulatory valve 230 regulates the flow of heated coolant into the heat exchanger 36.

The coolant flowing through the heat exchanger 36 transfers the heat to the heat exchanger 36, wherefrom the heat is transferred to the engine oil circulating in the heat exchanger 36. This transfer of heat from the coolant to the engine oil takes place via conduction. As such, the engine oil circulating in the heat exchanger 36 is heated, while the coolant flowing through the heat exchanger 36 is cooled. This method of heating engine oil using coolant at the heat exchanger 36 continues until the estimated engine oil dilution level falls below the first threshold and/or until the engine oil temperature exceeds the threshold limit. The increase in temperature of the engine oil beyond the threshold limit assists in evaporating fuel or water from engine oil, thereby improving lubrication capacity of the engine oil. After the completion of the transfer of heat, the cooled coolant may be circulated back to the coolant lines of the EGHR device 34 and the GPF 90 from the heat exchanger 36. In some examples where the coolant circuit 439 is coupled to the main engine coolant loop 250, after heat transfer at the heat exchanger 36 the coolant may be configured to be routed back to the main engine coolant loop 250 from the heat exchanger 36 via a different passage (not shown).

As the oil dilution level falls below the first threshold and/or the engine oil temperature exceeds the threshold limit, oil heating may no longer be needed. As such, the regulatory valve 230 may be closed and the coolant circuit 439 may be inactivated when oil heating is not indicated. Consequently, heating of the coolant 410 surrounding the exhaust components via PCM and routing of the heated coolant to the heat exchanger 36 via the passages 440 and 441 may be terminated. However, coolant flowing through the main engine coolant loop 250 may remain unaffected.

In the illustrated example, the heat transfer method from coolant to engine oil via PCM, is shown in reference to the EGHR device and the GPF only. In other examples, however, coolant from other exhaust components, such as muffler, catalyst, etc. may also be configured to be routed to the heat exchanger for heating of engine oil, in a similar manner as described above. Accordingly, muffler, catalyst, etc. may have a similar set-up of PCM and coolant circuit as described above for the EGHR device and GPF.

Figure 5:
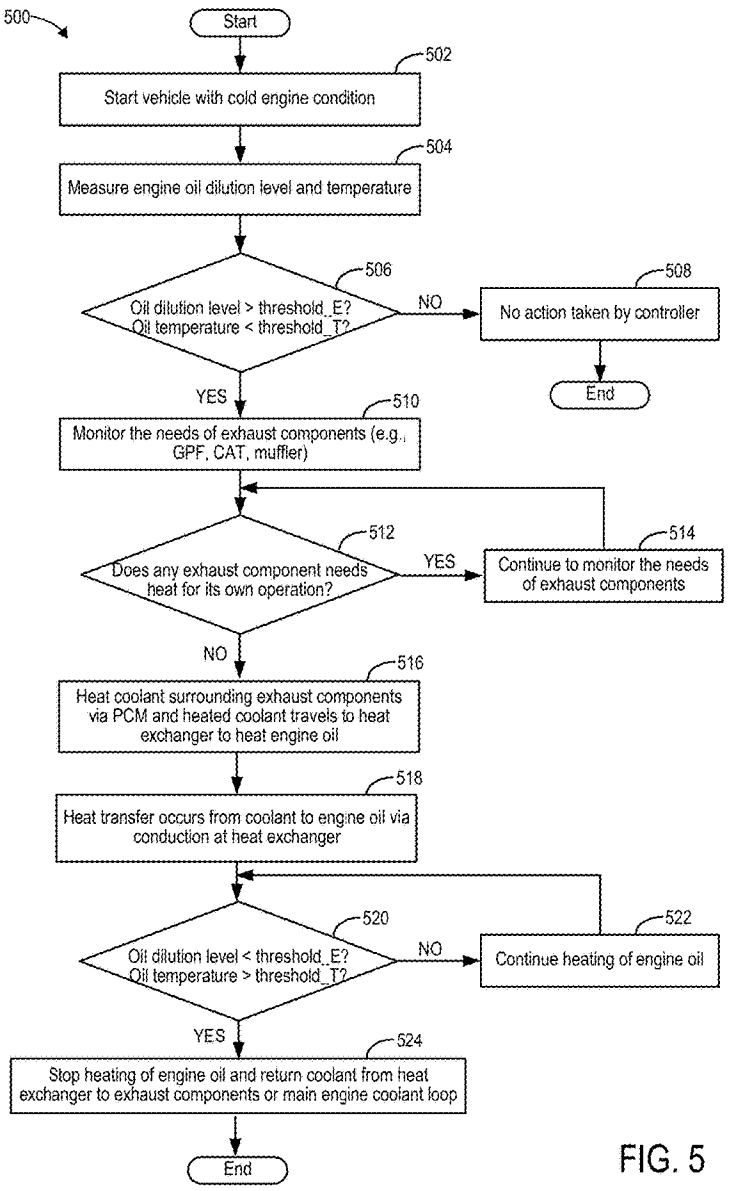
FIG. 5 shows a high-level flow chart of the controls for method of heating oil, in accordance with the second example embodiment of FIG. 4.
Figure 6:
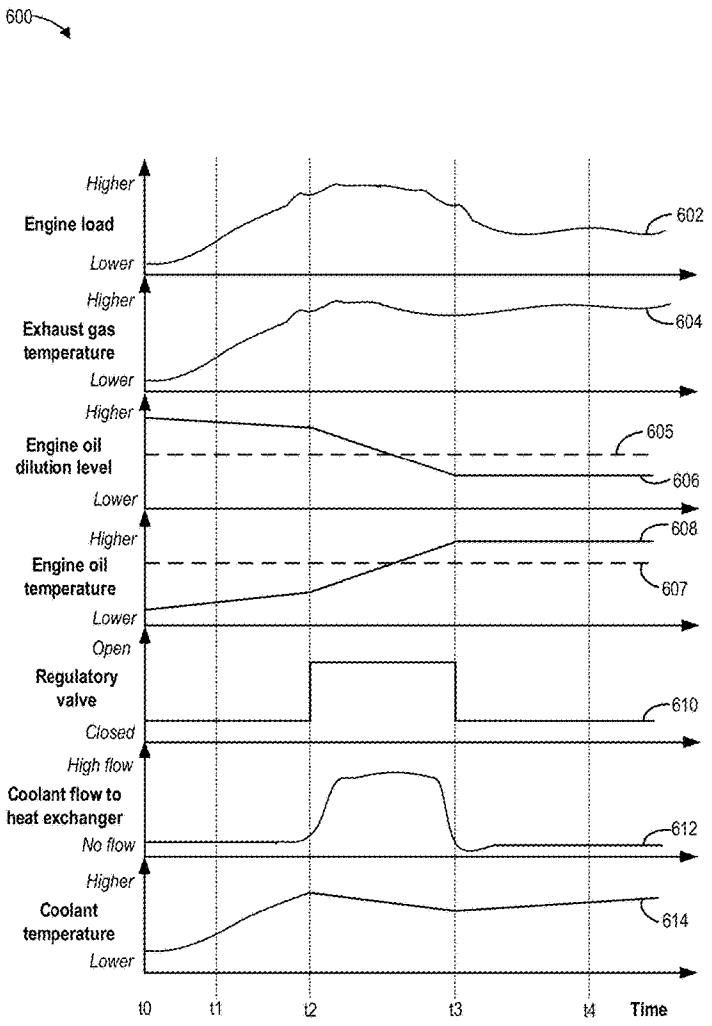
FIG. 6 shows graphs illustrating example engine oil heating operation responsive to oil dilution level or oil temperature during an engine cold-start.

Referring now to FIG. 5, an example method 500 for engine oil heating is shown, in accordance with the second example embodiment of FIG. 4. Instructions for carrying out method 500 may be executed by a controller based on instructions stored in a memory of the controller and in conjunction with signals received from sensors of the vehicle system, such as the sensors and controller described above with reference to FIGS. 1-4.

At 502, the method includes starting or operating a vehicle. In one example, the vehicle may be operated under cold engine conditions. At 504, the method includes estimating and/or measuring engine oil dilution level. The engine oil dilution level may be estimated and/or measured by the controller from one or more of an output of an intake oxygen sensor, commanded fuel injection quantities, and/or measurement of oil viscosity, for example. Additionally, method 500 may also include estimating and/or measuring engine oil temperature at 504.

At 506, the method further includes determining if the engine oil dilution level is greater than a first threshold (e.g., threshold_E). At 506, the method may also include determining whether the engine oil temperature is lower than a temperature threshold (e.g., threshold_T). If it is determined that engine oil dilution level is below threshold_E (or the first threshold) or if it is determined that engine oil temperature is greater than threshold_T (or the temperature threshold), method 500 continues to 508, where no action is taken by controller and PCM/coolant circuit is not activated (only the main engine coolant loop remains active) and then ends. On the other hand, if it is established that engine oil dilution level is greater than threshold_E or engine oil temperature is lower than threshold_T, method 500 proceeds to 510.

At 510, the heat demands of various exhaust components of the vehicle system such as EGHR device, GPF, muffler, and catalyst may be monitored. For example, it may be monitored whether EGHR device or GPF needs high heat for its own operation. As one example, GPF may need high heat to burn all the soot off. Depleting the heat at the GPF by operating the PCM and coolant circuit when the GPF is actively burning soot would interfere with GPF's own operation. As another example, GPF may have burnt all the accumulated soot and does not need high heat temporarily as it waits for new soot accumulation. Therefore, depending on the heat demands of the exhaust components, heating and routing of the coolant from the coolant circuit surrounding EGHR device, GPF, or other exhaust components may be controlled.

At 512, the method determines whether any of the exhaust components requires heat for its own operation. If it is determined at 512 that the exhaust components require heat for their own functions, method 500 continues to 514, where monitoring of the heat demands of the exhaust components is continued. On the other hand, if it is established that the primary functions of the EGHR device, GPF, or other exhaust components are completed, and the heat is temporarily not required by the exhaust components, method 500 progresses to 516.

At 516, the coolant of the coolant circuit surrounding the exhaust components (such as GPF and EGHR device) is heated via phase change material (PCM) and the heated coolant from GPF and EGHR device is directed to a heat exchanger, where the heated coolant is used to increase the temperature of engine oil. The heating of coolant and routing of heated coolant to heat exchanger from the exhaust components may occur via the activation of the coolant circuit, in the same way as described previously with reference to FIG. 4.

At 518, the method further includes allowing heat transfer from heated coolant to engine oil at the heat exchanger. The transfer of heat occurs via conduction, as described previously in FIG. 4. This leads to an increase in the temperature of the engine oil circulating in the heat exchanger and a decrease in the temperature of the coolant flowing through the heat exchanger.

At 520, the method includes determining if the engine oil dilution level has fallen below threshold_E (or the first threshold) or if the engine oil temperature has exceeded threshold_T (or the temperature threshold). If it is determined at 520 that engine oil dilution level is greater than threshold_E or if it is determined that engine oil temperature is lower than threshold_T, method 500 continues to 522, where rerouting of heated coolant and heating of engine oil continue. On the other hand, if it is established that engine oil dilution level is below threshold_E or engine oil temperature is greater than threshold_T, method 500 proceeds to 524.

At 524, heating and routing of coolant to heat exchanger from EGHR device and GPF is stopped. The heating of engine oil is also terminated. The coolant from the heat exchanger either returns to EGHR device/GPF or it is routed back to the main engine coolant loop, as described previously with reference to FIG. 4.

FIG. 6 shows an engine operation map 600 to illustrate the methods of engine oil heating described above. Map 600 shows engine load at plot 602, exhaust gas temperature at plot 604, engine oil dilution level at plot 606, engine oil temperature at plot 608, position of regulatory valve at plot 610, flow of coolant to a heat exchanger at plot 612, and coolant temperature at plot 614. All the above are plotted against time on the X-axis and time increases from the left of the X-axis to the right. Dotted line 605 represents the first threshold (e.g. Threshold_E) for engine oil dilution level, and dotted line 607 represents the temperature threshold (e.g. Threshold_T) for engine oil temperature. Thus, the dotted line 605 represents an oil dilution threshold above which the opening of the regulatory valve is activated for flow of coolant into the heat exchanger (when other conditions are met). The dotted line 607 represents an engine oil temperature threshold above which the regulatory valve closure may be activated to stop the flow of coolant to the heat exchanger.

At t0, the vehicle is engaged under cold start conditions. Thereafter, engine load starts to increase at plot 602 as the vehicle is driven. During the time period from t0 to t1, the temperature of exhaust gas at plot 604 also starts to increase in proportion to the engine load. Engine oil temperature at plot 608 may be considerably lower than the temperature threshold (dotted line 607) and engine oil dilution level at plot 606 may be higher than the first threshold (dotted line 605). Additionally, coolant temperature at plot 614 is also considerably low at cold start. Between t0 and t1, the regulatory valve at plot 610 remains closed. Accordingly, there is no flow of coolant to the heat exchanger during this time, as shown by plot 612.

Between t1 and t2, the load on the engine further increases at plot 602 and so is the exhaust gas temperature at plot 604. Engine oil temperature at plot 608 may increase slowly between t1 and t2 due to heat transfer from exhaust gas to engine oil, but may not reach the temperature threshold (dotted line 607). Accordingly, engine oil dilution level at plot 606 may decrease slowly up to a certain extent between t1 and t2, but may still be considerably higher than the first threshold (dotted line 605). The coolant may be heated according to the methods and systems described in the present disclosure. Consequently, the temperature of the coolant may start rising at plot 614 between t1 and t2. During this period, the regulatory valve at plot 610 remains closed with no flow of coolant to the heat exchanger, as shown by plot 612.

From t2 to t3, the engine is operated at a high load, as is indicated by the plot 602. Additionally, the exhaust gas temperature has reached a desired temperature (e.g., light-off temperature or above) at plot 604. At t2, the engine oil dilution level (plot 606) is considerably higher than the first threshold (dotted line 605) and the engine oil temperature (plot 608) is considerably lower than the temperature threshold (dotted line 607). In response to these parameters, the regulatory valve at plot 610 may be adjusted to an open position. Consequently, the flow of heated coolant to the heat exchanger (plot 612) starts increasing at t2. Due to the opening of the regulatory valve, increased coolant flow to the heat exchanger may take place throughout the period from t2 to t3. As heat exchange occurs between coolant and engine oil at the heat exchanger, engine oil temperature at plot 608 may increase at a faster rate between t2 and t3, thereby reaching the temperature threshold (dotted line 607). Consequently, engine oil dilution level at plot 606 decreases at a faster rate between t2 and t3, thereby reaching the first threshold (dotted line 605). The decrease in engine oil dilution level is because of fuel and/or water evaporating from engine oil at higher temperatures. Additionally, due to the heat transfer from coolant to engine oil, the coolant temperature between t2 and t3 may reduce slightly, as shown by the plot 614. However, in some examples, there may not be a noticeable decrease in the coolant temperature between t2 and t3, considering the entire coolant system.

At t3, the engine oil temperature (plot 608) exceeds the temperature threshold (dotted line 607) and is considerably higher than the temperature threshold (dotted line 607). At t3, the engine oil dilution level (plot 606) has crossed the first threshold (dotted line 605) and is considerably lower than the first threshold (dotted line 605). In response to these parameters, the regulatory valve at plot 610 may be adjusted to a closed position at t3. Accordingly, the flow of coolant to the heat exchanger (plot 612) is discontinued at t3.

Between t3 and t4, engine load (plot 602) may remain at moderate levels and exhaust gas temperature (plot 604) may remain at high levels. Since the regulatory valve at plot 610 remains closed, there is no flow of coolant to the heat exchanger during the period t3 to t4, as indicated by plot 612. Accordingly, no heat exchange between coolant and engine oil occurs during the period t3 to t4. Consequently, engine oil temperature may remain steady (plot 608) and no further decrease in engine oil dilution level (plot 606) is exhibited between t3 and t4. The plot 606 and the plot 608 may plateau during this period with no further changes. However, in some examples, engine oil temperature may decrease after t3 until the oil temperature reaches engine temperature or another desired temperature. Furthermore, the coolant temperature (plot 614) between t3 and t4 may start rising again for the normal operation of exhaust components.

Methods and systems, according to the present disclosure, provide several advantages. The present invention greatly improves the ability to overcome water/fuel dilution of oil through an incremental response, especially in hybrid vehicles. As hybrid vehicles tend to have shorter drive cycles than conventional vehicles, frequent heating of engine oil above a temperature threshold to cause evaporation of water or fuel is difficult. The methods and systems, according to the present disclosure, quickly transfer waste heat from the exhaust gas to the oil via coolant circulation in order to increase oil temperature above the temperature threshold, thereby controlling oil dilution. This method of heating oil relies on both the EGHR device and the EGR cooler. The method allows faster heating of coolant as both the EGHR device and the EGR cooler may be operated simultaneously, and therefore, allowing faster heating of engine oil as heated coolant from both the EGHR device and the EGR cooler may be mixed and circulated through the heat exchanger. The method, according to the present disclosure, controls engine oil dilution without interfering with the primary functions or normal operation of EGR cooler, EGHR device, GPF, catalyst or other exhaust components. The present invention may be applied to both full hybrid electric vehicles (FHEV) as well as plug-in hybrid electric vehicles (PHEV).

In this way, engine oil dilution may be reduced when engines experience shorter drive cycles or function in colder climates. By reducing engine oil dilution, engine oil viscosity may be maintained at a desired viscosity level for engine lubrication and reducing wear. Overall, engine oil quality may be maintained for a longer duration, and engine durability may be improved. Additionally, the present invention allows navigation choice for autonomous and non-autonomous vehicles, and an enhancement of driver notification to prevent customer dissatisfaction.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. Moreover, unless explicitly stated to the contrary, the terms "first," "second," "third," and the like are not intended to denote any order, position, quantity, or importance, but rather are used merely as labels to distinguish one element from another. The subject matter of the present disclosure includes all novel and non-obvious combinations and sub-combinations of the various systems and configurations, and other features, functions, and/or properties disclosed herein.

As used herein, the term "approximately" is construed to mean plus or minus five percent of the range unless otherwise specified.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method for operating a vehicle, comprising:

heating coolant by operating an exhaust gas heat recovery device and circulating the heated coolant via a first coolant loop between the exhaust gas heat recovery device and a heat exchanger; and heating coolant by operating an exhaust gas recirculation cooler and circulating the heated coolant via a second coolant loop between the exhaust gas recirculation cooler and the heat exchanger, wherein the heated coolant from both the exhaust gas heat recovery device and the exhaust gas recirculation cooler mix at the heat exchanger and allows heating of an engine oil via the heat exchanger, and wherein the engine oil is heated via the heated coolant from the exhaust gas recirculation cooler and the exhaust gas heat recovery device when a temperature of the engine oil is less than a threshold limit.

2. The method of claim 1, wherein the heat exchanger is a coolant to oil heat exchanger with the engine oil flowing through the heat exchanger.

3. The method of claim 2, wherein a transfer of heat between the heated coolant and the engine oil takes place via conduction.

4. The method of claim 1, wherein the second coolant loop further includes a charge air cooler for heating the coolant.

5. A method for operating a vehicle, comprising:

heating coolant by operating an exhaust gas heat recovery device and circulating the heated coolant via a first coolant loop between the exhaust gas heat recovery device and a heat exchanger; and heating coolant by operating an exhaust gas recirculation cooler and circulating the heated coolant via a second coolant loop between the exhaust gas recirculation cooler and the heat exchanger, wherein the heated coolant from both the exhaust gas heat recovery device and the exhaust gas recirculation cooler mix at the heat exchanger and allows heating of an engine oil via the heat exchanger, and wherein the engine oil is heated via the heated coolant from the exhaust gas recirculation cooler and the exhaust gas heat recovery device when a dilution level of the engine oil is greater than a first threshold.

6. A method for operating a vehicle, comprising:

heating coolant by operating an exhaust gas heat recovery device and circulating the heated coolant via a first coolant loop between the exhaust gas heat recovery device and a heat exchanger; and heating coolant by operating an exhaust gas recirculation cooler and circulating the heated coolant via a second coolant loop between the exhaust gas recirculation cooler and the heat exchanger, wherein the heated coolant from both the exhaust gas heat recovery device and the exhaust gas recirculation cooler mix at the heat exchanger and allows heating of an engine oil via the heat exchanger, and wherein a flow of the coolant bypasses the heat exchanger when a temperature of the engine oil is greater than a threshold limit or a dilution level of the engine oil is less than a first threshold.

7. A method for operating a vehicle, comprising:

heating coolant by operating an exhaust gas heat recovery device and circulating the heated coolant via a first coolant loop between the exhaust gas heat recovery device and a heat exchanger; and heating coolant by operating an exhaust gas recirculation cooler and circulating the heated coolant via a second coolant loop between the exhaust gas recirculation cooler and the heat exchanger, wherein the heated coolant from both the exhaust gas heat recovery device and the exhaust gas recirculation cooler mix at the heat exchanger and allows heating of an engine oil via the heat exchanger, and wherein a flow of the coolant into the heat exchanger is regulated by a regulatory valve.

8. A method for operating a vehicle, comprising:

heating coolant by operating an exhaust gas heat recovery device and circulating the heated coolant via a first coolant loop between the exhaust gas heat recovery device and a heat exchanger; and heating coolant by operating an exhaust gas recirculation cooler and circulating the heated coolant via a second coolant loop between the exhaust gas recirculation cooler and the heat exchanger, wherein the heated coolant from both the exhaust gas heat recovery device and the exhaust gas recirculation cooler mix at the heat exchanger and allows heating of an engine oil via the heat exchanger, and wherein the exhaust gas heat recovery device further comprises a gas flow conduit and a gas-to-liquid heat exchanger.

9. The method of claim 8, wherein an exhaust gas flows in a first direction through the gas flow conduit of the exhaust gas heat recovery device, and the coolant flows in a second direction, opposite the first, through the gas-to-liquid heat exchanger of the exhaust gas heat recovery device.

10. A vehicle, comprising:

an engine; and a controller programmed to, operate an exhaust component of the engine to heat coolant surrounding the exhaust component via a phase change material in thermal contact with the exhaust component and the coolant, in response to a dilution level of an engine oil or a temperature of the engine oil, and recirculate the heated coolant surrounding the exhaust component to a coolant to oil heat exchanger via a coolant circuit, where the coolant to oil heat exchanger, via the heated coolant, heats the engine oil flowing through the coolant to oil heat exchanger to increase the temperature of the engine oil.

11. The method of claim 10, wherein the exhaust component is a component of an exhaust gas heat recovery device, a gasoline particulate filter, a muffler, or a catalyst.

12. The method of claim 11, wherein at least a portion of the exhaust component is sheathed by a thermal jacket comprising the phase change material.

13. The method of claim 12, wherein the phase change material is configured to remain physically separate from the coolant flowing around the exhaust component.

14. The method of claim 11, wherein the engine oil is heated via the coolant surrounding the exhaust component when the dilution level of the engine oil is greater than a first threshold or the temperature of the engine oil is lower than a threshold limit.

15. The method of claim 14, wherein a transfer of heat between the coolant and the engine oil takes place via conduction.

16. The method of claim 10, wherein a flow of the coolant into the coolant to oil heat exchanger is regulated by a regulatory valve.

17. The method of claim 16, wherein the flow of the coolant into the coolant to oil heat exchanger stops when the temperature of the engine oil is greater than a threshold limit or the dilution level of the engine oil is less than a first threshold.

18. A method for controlling engine oil dilution in a vehicle, the method comprising:

operating an exhaust gas heat recovery device configured to heat coolant for an engine to increase a temperature of the coolant; and responsive to an estimated oil dilution level of the engine exceeding a first threshold and engine oil temperature below a temperature threshold, routing the heated coolant from the exhaust gas heat recovery device to a coolant to oil heat exchanger to increase a temperature of the engine oil.

19. The method of claim 18, wherein routing the heated coolant from the exhaust gas heat recovery device to the coolant to oil heat exchanger comprises controlling a flow of the heated coolant into the coolant to oil heat exchanger via a regulatory valve.

* * * * *